US012504240B2

(12) United States Patent
Snyder et al.

(10) Patent No.: US 12,504,240 B2
(45) Date of Patent: Dec. 23, 2025

(54) HEAT EXCHANGER WITH EXPANSION JOINT INSERT FOR THERMAL EXPANSION AND EXTERNAL FORCE TOLERANCE

(71) Applicant: Rolls-Royce North American Technologies Inc., Indianapolis, IN (US)

(72) Inventors: Douglas J. Snyder, Indianapolis, IN (US); Michel S. Smallwood, Indianapolis, IN (US)

(73) Assignee: Rolls-Royce North American Technologies Inc., Indianapolis, IN (US)

( * ) Notice: Subject to any disclaimer, the term of this patent is extended or adjusted under 35 U.S.C. 154(b) by 104 days.

(21) Appl. No.: 18/647,878

(22) Filed: Apr. 26, 2024

(65) Prior Publication Data

US 2025/0334355 A1 Oct. 30, 2025

(51) Int. Cl.
*F28F 9/02* (2006.01)

(52) U.S. Cl.
CPC ..... *F28F 9/0231* (2013.01); *F28F 2265/26* (2013.01)

(58) Field of Classification Search
CPC ..... F28F 2265/26; F28F 1/08; F28F 9/0231; F02C 7/10
USPC ..... 165/81
See application file for complete search history.

(56) References Cited

U.S. PATENT DOCUMENTS

| | | | | |
|---|---|---|---|---|
| 2,933,291 | A * | 4/1960 | Huggins | F28D 7/1638 165/83 |
| 3,968,834 | A | 7/1976 | Mangus | |
| 4,246,959 | A | 1/1981 | Byrne | |
| 4,291,752 | A | 9/1981 | Bridgnell | |
| 4,750,327 | A | 6/1988 | Wohrl | |
| 5,243,815 | A * | 9/1993 | Maier | F02C 7/08 60/800 |
| 5,797,449 | A | 8/1998 | Oswald | |
| 8,794,299 | B2 * | 8/2014 | Barfknecht | F28F 9/0236 165/145 |
| 9,488,408 | B2 * | 11/2016 | Shelat | F25J 5/005 |
| 10,994,916 | B2 * | 5/2021 | Getsay | B65D 81/3879 |
| 11,719,489 | B2 * | 8/2023 | Fumoto | F01N 13/1816 165/157 |
| 2003/0116305 | A1 | 6/2003 | Beddome | |
| 2003/0159807 | A1 | 8/2003 | Ayres | |
| 2013/0299134 | A1 * | 11/2013 | Deschamps | F16L 59/21 285/47 |
| 2014/0007569 | A1 | 1/2014 | Gayton | |

(Continued)

FOREIGN PATENT DOCUMENTS

WO WO-2008106188 A1 * 9/2008 ..... F28D 7/1692

OTHER PUBLICATIONS

Thulukkanam, Kuppan, Heat Exchanger Design Handbook, Second Edition, Chapter 5, 106 pages.

*Primary Examiner* — Jon T. Schermerhorn, Jr.
(74) *Attorney, Agent, or Firm* — Barnes & Thornburg

(57) ABSTRACT

A multi-piece heat exchanger for transferring heat between a hot working fluid and a coolant according to the disclosure includes a multi-piece shell, a core, and first and second expansion joints. The multi-piece shell is arranged around an axis and receives coolant therein. The core is located within the shell and direct a hot working fluid therethrough.

8 Claims, 5 Drawing Sheets

(56) References Cited

U.S. PATENT DOCUMENTS

| | | | | |
|---|---|---|---|---|
| 2014/0090821 | A1* | 4/2014 | Suzuki | B23P 15/26 29/890.03 |
| 2014/0360698 | A1 | 12/2014 | Waldman | |
| 2015/0114611 | A1 | 4/2015 | Morris | |
| 2017/0131035 | A1 | 5/2017 | Honnorat | |
| 2017/0138670 | A1* | 5/2017 | Penny | F28F 1/426 |
| 2019/0003784 | A1* | 1/2019 | Singh | F28D 7/1607 |

* cited by examiner

HEAT EXCHANGER WITH EXPANSION JOINT INSERT FOR THERMAL EXPANSION AND EXTERNAL FORCE TOLERANCE

STATEMENT REGARDING FEDERALLY SPONSORED RESEARCH OR DEVELOPMENT

Embodiments of the present disclosure were made with government support under Contract No. HQ0034-20-9-0012. The government may have certain rights.

FIELD OF THE DISCLOSURE

The present disclosure relates generally to heat exchangers, and more specifically to heat exchangers adapted for thermal expansion and external force tolerance.

BACKGROUND

Heat exchangers are used to exchange heat between two fluids. In typical heat exchangers, a core is built with many tubes extending between end plates. One fluid flows around the tubes within a shell of the heat exchanger, while another fluid flows within the inside of the tubes. The tubes may be welded or brazed into the end plates to keep the fluids separate from each other. In addition, the end plates may be held in place by attaching them to the shell and headers of the heat exchanger.

When the temperature difference between the fluids is relatively low, any relative thermal expansion of the heat exchanger components does not develop significant thermo-mechanical stresses on the heat exchanger components. However, when the temperature difference between the fluids is significantly large, such as the fluid inside the tubes being hotter than the fluid in the shell, the shell does not thermally expand as much as the tubes. This leads to significant compressive stresses applied to the tubes. Because the core is typically made with thin walls (i.e., the tubes) and has a large surface area to minimize thermal resistance, a large temperature difference between the fluids may cause the tubes to change in temperature at a rapid rate. On the other hand, the shell is typically thick to support pressure loads and does not have a lot of area for heat transfer. As a result, a heat exchanger that suddenly has hot fluid introduced in the core (including the tubes) can generate significant loads in the tubes and put the tubes in compression. This can lead to failure of the heat exchanger. Failure may also occur in the heat exchanger when the fluid introduced in the core (including the tubes) is significantly colder than the fluid in the shell, which can generate significant loads in the tubes and put the tubes in tension.

Conventional solutions to this problem in heat exchangers include removing a joint between an end plate and the shell to create a sliding joint or gap. The tubes are allowed to expand independently of the shell. However, these conventional solutions also introduce new challenges. One challenge is that when the heat exchanger is installed in a larger system, the system can apply large mechanical loads onto the heat exchanger via the header that are then transmitted directly into the core. This may make it difficult to integrate the heat exchanger into a system while maintaining an acceptable reliability of the heat exchanger. Another challenge is that the sliding joint or gap may allow fluid to leak from the heat exchanger. While seals can be implemented, they are often imperfect, are less resistant to high temperatures, and fluid will still leak from the heat exchanger.

Therefore, it is also desired to block leakage of fluid from the heat exchange while allowing thermal expansion of the tubes.

SUMMARY

The present disclosure may comprise one or more of the following features and combinations thereof.

A multi-piece heat exchanger for transferring heat between a hot working fluid and a coolant according to the present disclosure may comprise a multi-piece shell arranged around an axis, a core located within the shell, and a first expansion joint and a second expansion joint.

The multi-piece shell may receive a coolant therein. The multi-piece shell may extend axially relative to an axis between a first end and a second end. The multi-piece shell may include a first shell body and a second shell body coupled with the first shell body about a circumferential joint to define a cavity for receiving the coolant therein.

The core may be located within the cavity of the multi-piece shell and may direct a working fluid therethrough. The core may include a plurality of tubes extending axially relative to the multi-piece shell, a first header coupled to a first end of the plurality of tubes, and a second header coupled to a second end of the plurality of tubs. The plurality of tubes may define a tube flow path for the hot working fluid. The first header may distribute the hot working fluid through the plurality of tubes. The second header may receive cooled working fluid. The coolant in the multi-piece shell may around and between the plurality of tubes to cool the hot working fluid.

The first expansion joint may be coupled to the first shell body at the first end of the shell and the first header. The second expansion joint may be coupled to the second shell body at the second end of the shell and the second header. The first expansion joint and the second expansion joint may provide seals between the core and the multi-piece shell. The first and second expansion joints may each include bellows configured to transmit external forces through the shell and to allow thermal expansion of the plurality of tubes relative to the shell to minimize thermal stresses in the plurality of tubes so that the thermal stresses are blocked from damaging the plurality of tubes.

In some embodiments, the first header may include a first end plate coupled to the first end of the plurality of tubes and an axially-extending wall coupled between the first end plate and the first expansion joint. In some embodiments, the first end plate, the axially-extending wall, and the first expansion joint may cooperate to define an inlet flow path for the hot working fluid into the plurality of tubes.

In some embodiments, the second header may include a second end plate coupled to the second end of the plurality of tubes and an axially-extending wall coupled between the second end plate and the second expansion joint. In some embodiments, the second end plate, the axially-extending wall, and the second expansion joint cooperate to define an outlet header flow path for the cooled working fluid out of the plurality of tubes.

In some embodiments, the heat exchanger may further include a tab coupled to the second body of the shell. In some embodiments, the tab may extend radially-inward from the shell and may engage a core-facing surface of the inlet end plate to block axial movement of the inlet header beyond a plate-facing surface of the tab towards the second end of the shell and to prevent the first expansion joint from overloading.

In some embodiments, the second shell body may be separable from the first shell body. In some embodiments, the circumferential joint may be a bolted joint. In some embodiments, the circumferential joint may be a weld joint.

In some embodiments, the heat exchanger may further include a baffle located axially between the inlet header and the outlet header. In some embodiments, the baffle may be coupled to and extend radially inward from the shell to direct flow of the coolant.

In some embodiments, the first expansion joint, the second expansion joint, and the core may be provided as an insert located within the multi-piece shell.

These and other features of the present disclosure will become more apparent from the following description of the illustrative embodiments.

DETAILED DESCRIPTION OF THE DRAWINGS

Figure 1:
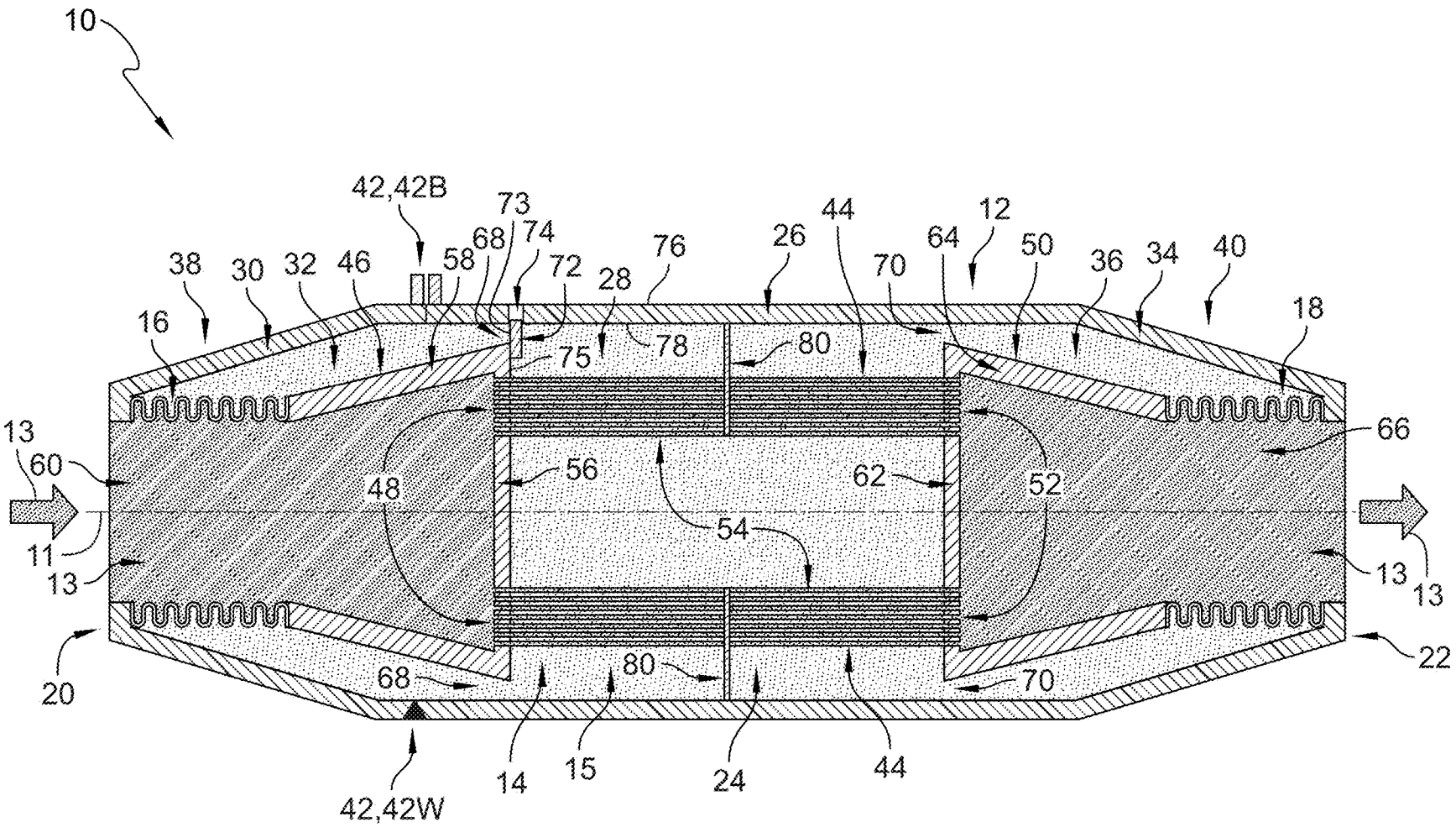
FIG. 1 is a section view of a heat exchanger showing that the heat exchanger includes a shell holding a coolant, a core located within the shell and directing a hot working fluid therethrough, and two expansion joints coupled between the core and the shell to provide a seal between the core and the shell and to allow thermal expansion of portions of the core and prevent damage to the core.

For the purposes of promoting an understanding of the principles of the disclosure, reference will now be made to a number of illustrative embodiments illustrated in the drawings and specific language will be used to describe the same.

A heat exchanger 10 for transferring heat between a working fluid 13 and a coolant 15 is disclosed herein. The working fluid 13 has a higher temperature than the coolant 15. The working fluid 13 may be hot, high pressure combustion products from a gas turbine engine, or may be hot water, hot gas, steam, refrigerant, or any hot fluid that may be cooled in a heat exchanger 10. The coolant 15 may be a gas, water, water-glycol, steam, a refrigerant, or any fluid that may be used as a coolant in a heat exchanger 10. Alternatively, the working fluid 13 may be significantly cooler than the coolant 15.

The heat exchanger 10 includes a shell 12, a core 14, and expansion joints 16, 18 coupled between the shell 12 and the core 14 as shown in FIG. 1. The shell 12 is arranged circumferentially around an axis 11 and defines a cavity 24 for receiving the coolant 15 therein. The core 14 is located within the cavity 24 and directs the hot working fluid 13 therethrough. The expansion joints 16, 18 are arranged circumferentially around the axis 11. The expansion joints 16, 18 are configured to allow thermal expansion of portions of the shell 12 relative to the core to minimize mechanical loads on the core 14 due to thermal expansion. The expansion joints 16, 18 also isolate the core 14 from external mechanical loads so that the mechanical loads are prevented from damaging portions of the core 14. In the illustrative embodiment, the heat exchanger 10 is a multi-piece heat exchanger 10.

The shell 12 extends axially relative to the axis 11 between a first end 20 and a second end 22 as shown in FIG. 1. The shell 12 defines a shell midsection 26 forming a core space 28 of the cavity 24, a first header segment 30 forming a first header space 32 of the cavity 24, and a second header segment 34 forming a second header space 36 of the cavity 24. The first header segment 30 is located axially between the first end 20 and the shell midsection 26, and the second header segment 34 is located axially between the shell midsection 26 and the second end 22. Inlets and outlets for the coolant 15 to enter and exit the shell 12 are not shown.

In the illustrative embodiment, the shell 12 is a multi-piece shell 12 including a first shell body 38 and a second shell body 40 coupled with the first shell body 38 about a circumferential joint 42 as shown in FIG. 1. The first shell body 38 and the second shell body 40 cooperate to define the cavity 24 for receiving the coolant 15 therein. In the illustrative embodiment, the first shell body 38 and a portion of the second shell body 40 define the first header segment 30. The rest of the second shell body 40 defines the shell midsection 26 and the second header segment 34. Alternatively, the first header segment 30 may be defined by only the first shell body 38, the shell midsection 26 may be defined by the first shell body 38 or both the first shell body 38 and the second shell body 40, and the second header segment 34 may be defined by both the first shell body 38 and the second shell body 40.

The circumferential joint 42 is a bolted joint 42B in some examples. Additionally or alternatively, the circumferential joint 42 is a weld joint 42W. In other embodiments, the shell 12 may be a single piece or may have more than two shell bodies 38, 40. In the illustrative embodiment, the circumferential joint 42 is located at the first header segment 30. In other embodiments, the circumferential joint 42 may be located at the shell midsection 26 or the second header segment 34. The second shell body 40 may be separable from the first shell body 38 via removal or destruction of the circumferential joint 42.

The core 14 is configured to direct hot working fluid 13 therethrough. As shown in FIG. 1, the core 14 includes a plurality of tubes 44, a first header 46 coupled a first end 48 of the plurality of tubes 44, and a second header 50 coupled to a second end 52 of the plurality of tubes 44. The first header 46 distributes the hot working fluid through the first end 48 of the plurality of tubes 44. The plurality of tubes 44 extends axially relative to the axis 11 and defines a tube flow path 54 for the hot working fluid 13. The coolant 15 in the shell 12 flows around and between the plurality of tubes 44 to cool the hot working fluid 13. The second header 50 receives the cooled working fluid 13 from the second end 52 of the plurality of tubes 44 to direct the cooled working fluid 13 away from the heat exchanger 10. The first header 46 may be an inlet header 46 and the second header 50 may be an outlet header 50 of the heat exchanger 10.

Figure 7:
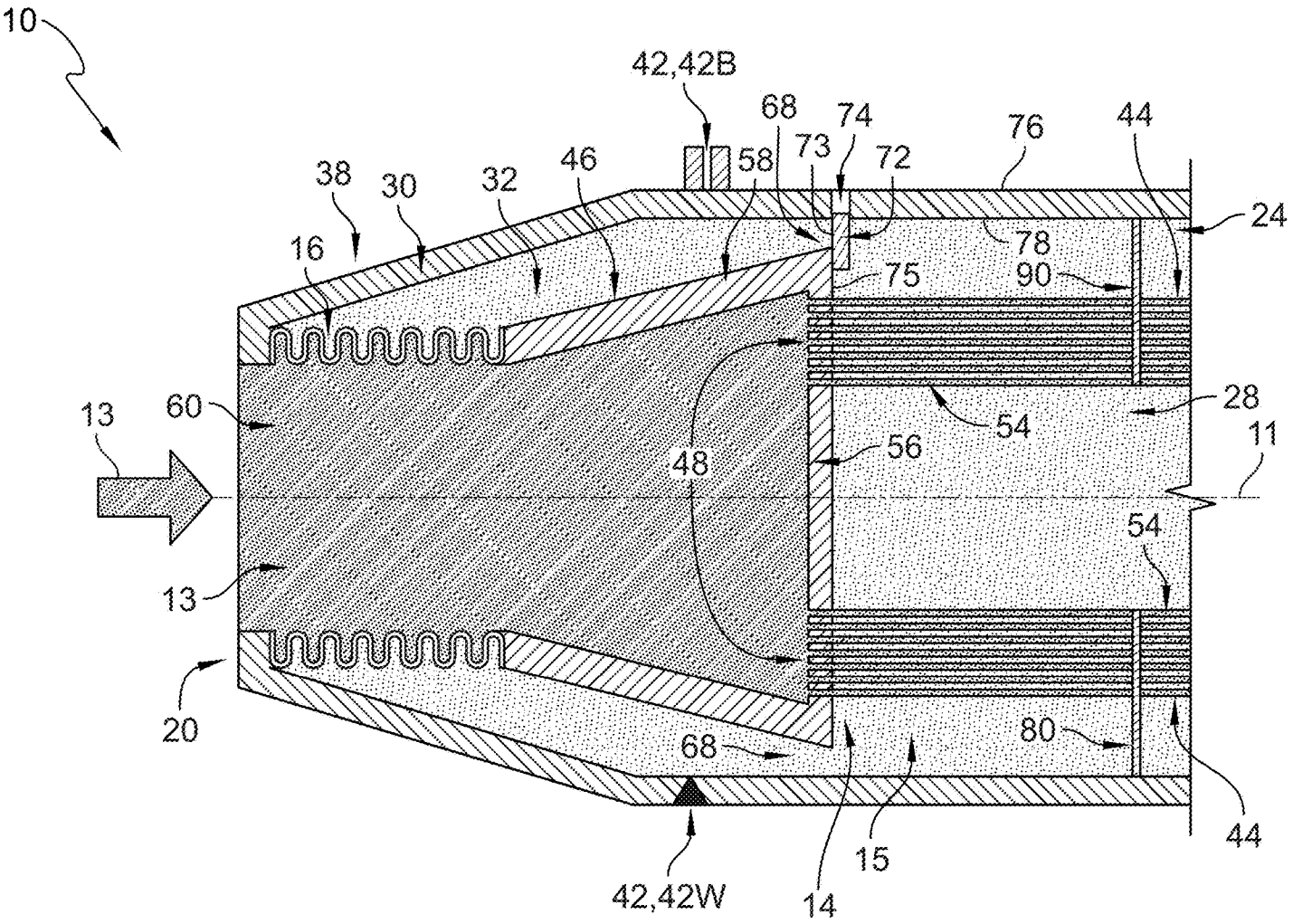
FIG. 7 is a detailed view of the heat exchanger of FIG. 1 showing that the core includes a second header coupled to another end of the plurality of tubes to provide another header flow path for the hot working fluid into the plurality of tubes.

The first header 46 includes a first end plate 56 and a first axially-extending wall 58 as shown in FIGS. 1 and 7. Both the first end plate 56 and the first axially-extending wall 58 are arranged circumferentially around the axis 11. The first end plate 56 is coupled to the first end 48 of the plurality of tubes 44. The first axially-extending wall 58 is coupled between the first end plate 56 and the first expansion joint 16. The first end plate 56, the first axially-extending wall 58, and the first expansion joint 16 cooperate to define an inlet flow path 60 for the hot working fluid 13 into the plurality of tubes 44.

Figure 2:
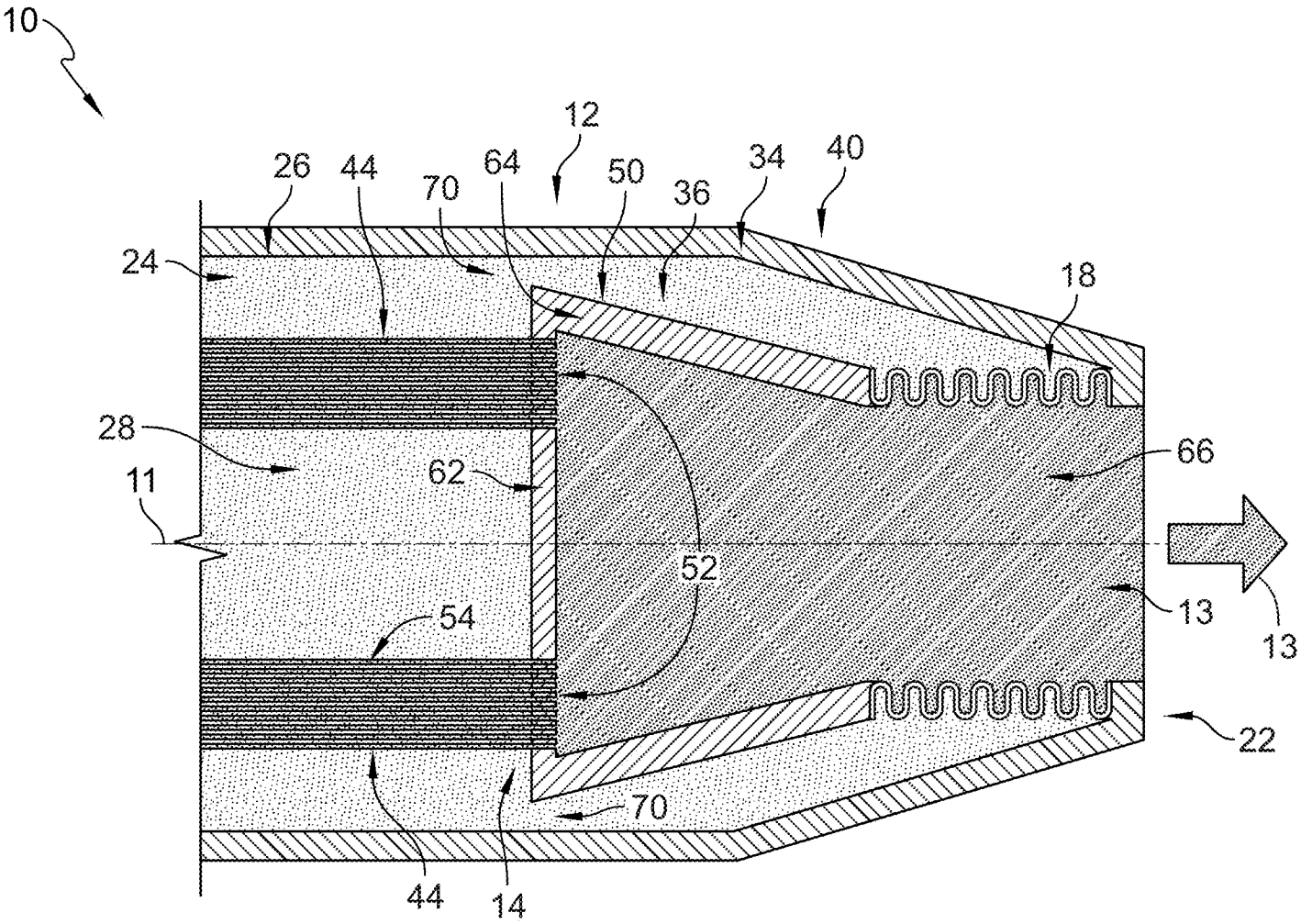
FIG. 2 is detailed view of the heat exchanger of FIG. 1 showing that the core includes a plurality of tubes defining a tube flow path for the hot working fluid to cool the hot working fluid and a header coupled to an end of the plurality of tubes to provide a header flow path for cooled working fluid, and further showing that one of the two expansion joints is coupled between an end of the shell and an axially-extending wall of the header.

Similarly, the second header 50 includes a second end plate 62 and a second axially-extending wall 64 as shown in FIGS. 1 and 2. Both the second end plate 62 and the second axially-extending wall 64 are arranged circumferentially around the axis 11. The second end plate 62 is coupled to the second end 52 of the plurality of tubes 44. The second axially-extending wall 64 is coupled between the second end plate 62 and the second expansion joint 18. The second end plate 62, the second axially-extending wall 64, and the second expansion joint 18 cooperate to define an outlet flow path 66 for the cooled working fluid 13 out of the plurality of tubes 44.

As shown in FIGS. 1, 2, and 7, both end plates 56, 62 are located radially inward of the shell midsection 26 of the shell 12 to define circumferential gaps 68, 70 radially between the shell midsection 26 of the shell 12 and the end plates 56, 62. The gaps 68, 70 allow the core 14 to move relative to the shell 12. As a result of the gaps 68, 70, the coolant 15 flows axially away from the core space 28 of the cavity 24 and into the first and second header spaces 32, 36 of the cavity 24. Thus, the coolant 15 surrounds both headers 46, 50 in the header spaces 32, 36, where very little heat transfer takes place. The coolant 15 in the header spaces 32, 36 may cool the hot working fluid 13 in the inlet flow path 60 and may further cool the cooled working fluid 13 in the outlet flow path 66. However, since the coolant 15 in the header spaces 32, 36 is not able to exit the shell 12 through the outlet (not shown), the coolant 15 in the header spaces 32, 36 becomes hot from the working fluid 13. Alternative solutions to pass or cool the coolant 15 in the header spaces 32, 36 is described in further detail below.

The first expansion joint 16 provides a seal between the core 14 and the shell 12. The first expansion joint 16 is coupled between the first shell body 38 at the first end 20 of the shell 12 and the first axially-extending wall 58 as shown in FIGS. 1 and 7. Likewise, the second expansion joint 18 also provides a seal between the core 14 and the shell 12. The second expansion joint 18 is coupled between the second shell body 40 at the second end 22 and the second axially-extending wall 64 as shown in FIGS. 1-6. Both expansion joints 16, 18 each include bellows 16, 18.

As the hot working fluid 13 is directed from the inlet flow path 60 and through the tube flow path 54 defined by the plurality of tubes 44, at least axial thermal expansion occurs to the plurality of tubes 44. The expansion joints 16, 18 are configured to allow thermal expansion of the plurality of tubes 44 relative to the shell 12 to minimize thermal stresses in the plurality of tubes 44. For example, one or both of the expansion joints 16, 18 as bellows 16, 18 may compress axially between the respective axially-extending walls 58, 64 and the respective ends 20, 22 of the shell when thermal expansion occurs in the plurality of tubes 44. The expansion joints 16, 18 have low axial stiffness so that the compression of the expansion joints 16, 18 generates minimal force within the expansion joints 16, 18. The compliance of one or both of the bellows 16, 18 also minimizes the amount of the external forces that get transmitted to the plurality of tubes 44. Rather, the external forces are transmitted through the shell 12, such as at the header segments 30.

In the illustrative embodiment shown in FIG. 1, the heat exchanger 10 includes both expansion joints 16, 18. However, in other embodiments, the heat exchanger 10 may have only one of the first and second expansion joints 16, 18 to transmit external forces through the shell 12 and away from the plurality of tubes 44.

The heat exchanger 10 further includes a tab 72 to block axial movement of the first header 46 between the tab 72 and the second end 22 of the shell 12 as shown in FIGS. 1 and 7. The tab 72 is inserted into a slot 74 formed between an opening into an outer surface 76 of the shell 12 and an inner surface 78 of the shell 12 opposite the outer surface 76. The tab 72 extends radially inward from the inner surface 78 of the shell 12. In some embodiments, the tab 72 may be welded or otherwise coupled to the shell 12. In some embodiments, the slot 74 may be further plugged to block coolant 15 from leaking from the shell 12.

The tab 72 includes a plate-facing surface 73 that is configured to engage a core-facing surface 75 of the first end plate 56 as shown in FIGS. 1 and 7. The tab 72 blocks axial movement of the first header 46 beyond the plate-facing surface 73 and towards the second end 22 of the shell 12. The tab 72 prevents the bellows 16 from overloading. The pressure of the hot working fluid 13 in the first header 46 is higher than the pressure of the working fluid 13 in the second header 50. The tab 72 prevents the pressure of the hot working fluid 13 from causing the header 46, and therefore the plurality of tubes 44 and the second header 50, from moving axially towards the second end 22 of the shell 12. In some embodiments, the tab 72 may be two or more tabs 72 inserted into respective slots 74 formed in and spaced circumferentially around the shell 12 to block axial movement of one of the first header 46, the plurality of tubes 44, and the second header 50 towards the second end 22 of the shell 12.

The heat exchanger 10 further includes one or more baffles 80 located axially between the first header 46 and the second header 50. The one or more baffles 80 are coupled to the plurality of tubes 44 and/or the shell 12 and extend radially between the plurality of tubes 44 and the shell 12 relative to the axis 11. The one or more baffles 80 direct flow of the coolant 15 around the plurality of tubes 44 to cool the working fluid 13. In other words, the one or more baffles 80 cooperate to make the heat exchanger 10 a multi-pass heat exchanger 10.

In the illustrative embodiment shown in FIG. 1, the heat exchanger 10 includes two expansion joints 16, 18 and two headers 46, 50 as shown and described in the present disclosure. In other embodiments, the heat exchanger may include only one expansion joint 16, 18. In such embodiments, a standard header for a heat exchanger may be coupled to an end plate 56, 62 and an expansion joint 16, 18 and header 46, 50 as shown and described in the present disclosure may be located between the plurality of tubes 44 and the other end 20, 22 of the shell.

In some embodiments, the temperature difference between the working fluid 13 and the coolant 15 may be between about 100 degrees Fahrenheit and about 1000 degrees Fahrenheit. In some embodiments, the temperature difference between the working fluid 13 and the coolant 15 may be less than about 100 degrees Fahrenheit or greater than about 1000 degrees Fahrenheit. In some embodiments, the temperature difference between the working fluid 13 and the coolant 15 may be between about 200 degrees Fahrenheit and about 400 degrees Fahrenheit. In some embodiments, the temperature difference may be less than about 200 degrees Fahrenheit or greater than about 400 degrees Fahrenheit. In some embodiments, the temperature difference may be about 300 degrees Fahrenheit.

Other embodiments of the heat exchanger 210, 310, 410, and 510 in accordance with the present disclosure are shown in FIGS. 3-6. FIGS. 3-6 include features relating to the second end 52 of the plurality of tubes 44, the second header 50, and the second end 22 of the shell 12. However, the features shown and described in FIGS. 3-6 may also apply to the first end 48 of the plurality of tubes 44, the first header 46, and the first end 20 of the shell. In other words, the features shown and described in FIGS. 3-6 may be applied interchangeably to either side of the heat exchanger 10, 210, 310, 410, and 510.

The heat exchangers 210, 310, 410, and 510 are substantially similar to the heat exchanger 10 shown in FIGS. 1, 2, and 7. Accordingly, similar reference numbers indicate features that are common between the heat exchanger 10 and the heat exchangers 210, 310, 410, and 510. The description of the heat exchanger 10 is incorporated by reference to apply to the heat exchangers 210, 310, 410, and 510, except in instances when it conflicts with the specific description and the drawings of the heat exchangers 210, 310, 410, and 510.

Figure 3:
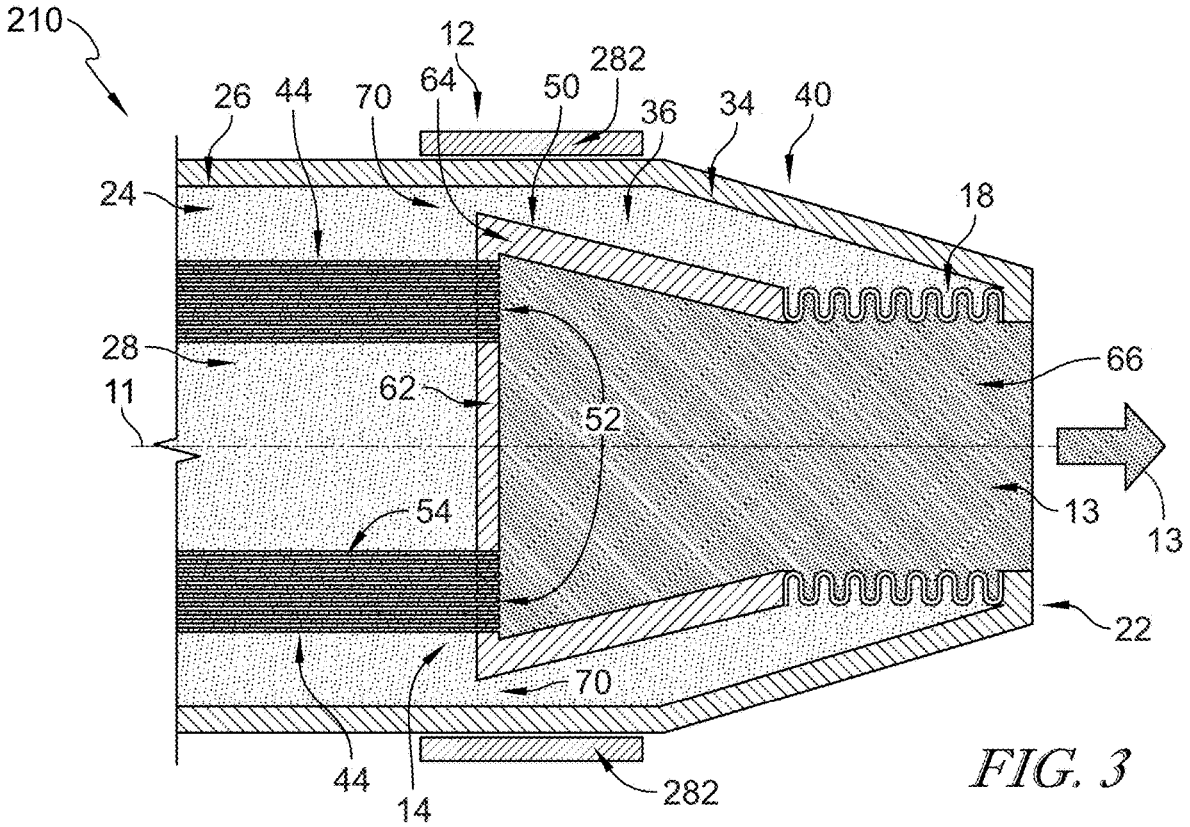
FIG. 3 is a detailed view of another embodiment of the heat exchanger of FIG. 2 showing that the heat exchanger further includes a heat-spreader ring coupled to an outer surface of shell to help distribute heat in the shell to the spatial thermal gradient in the shell and therefore reduce thermo-mechanical stresses.

As shown in FIG. 3, the heat exchanger 210 includes the shell 12, the core 14, and the second expansion joint 18 as described with reference to FIGS. 1, 2, and 7 above. The heat exchanger 210 further includes a heat-spreader ring 282 coupled to the outer surface 76 of the shell 12. The heat-spreader ring 282 is configured to minimize a thermal gradient in the shell 12. High thermal gradients typically lead to high mechanical stresses in the shell 12. The heat-spreader ring 282 assists in spreading heat in the shell 12 to generate a more gradual spatial change in temperatures in the shell 12. The heat spreader 282 may have different radial thicknesses to assist with managing the thermal gradient in the shell 12.

In the illustrative embodiment shown in FIG. 3, the heat-spreader ring 282 is extends circumferentially around a portion of the shell midsection 26 of the shell 12 and a portion of the second header segment 34 of the shell 12. In other embodiments, the heat-spreader ring 282 may extend circumferentially around a portion of the shell midsection 26 and the first header segment 30 to prevent large thermal gradients in the shell 12. Alternatively, the heat exchanger 210 may include two heat-spreader rings 282 each arranged between the shell midsection 26 and the header segments 30, 34. In some embodiments, the heat-spreader ring 282 may be a plurality of heat-spreader segments 282 spaced apart and arranged circumferentially around the shell 12. The heat-spreader ring 282 may comprise heat pipes or any highly conductive material including but not limited to copper.

Figure 4:
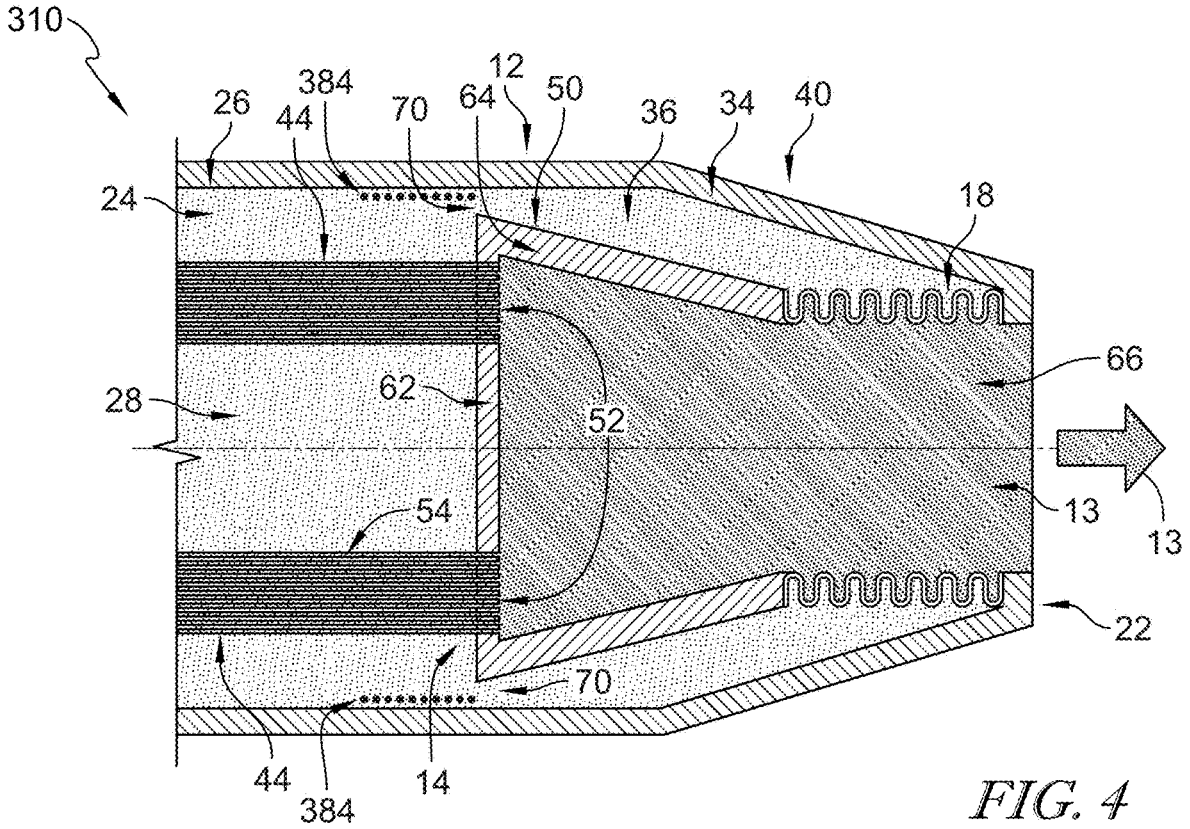
FIG. 4 is a detailed view of another embodiment of the heat exchanger of FIG. 2 showing that the heat exchanger further includes a heat shield coupled to an inner surface of the shell to minimize heat transfer from or to the shell.

As shown in FIG. 4, the heat exchanger 310 includes the shell 12, the core 14, and the second expansion joint 18 as described with reference to FIGS. 1, 2, and 7 above. The heat exchanger 310 further includes a heat shield 384 coupled to the inner surface 78 of the shell 12. The heat shield 384 is configured to minimize heat transfer to or from the coolant 15 from or to the shell 12 to reduce thermal gradient in the shell 12. The heat shield 384 may comprise ceramic, sheet metal with a fluid gap (not shown) radially between the heat shield 384 and the shell 12, or any other material which provides insulation. The heat shield 384 may be variable thickness or perforations to have variable insulating properties along the length of the shell 12 to achieve the desired thermal gradient.

Figure 5:
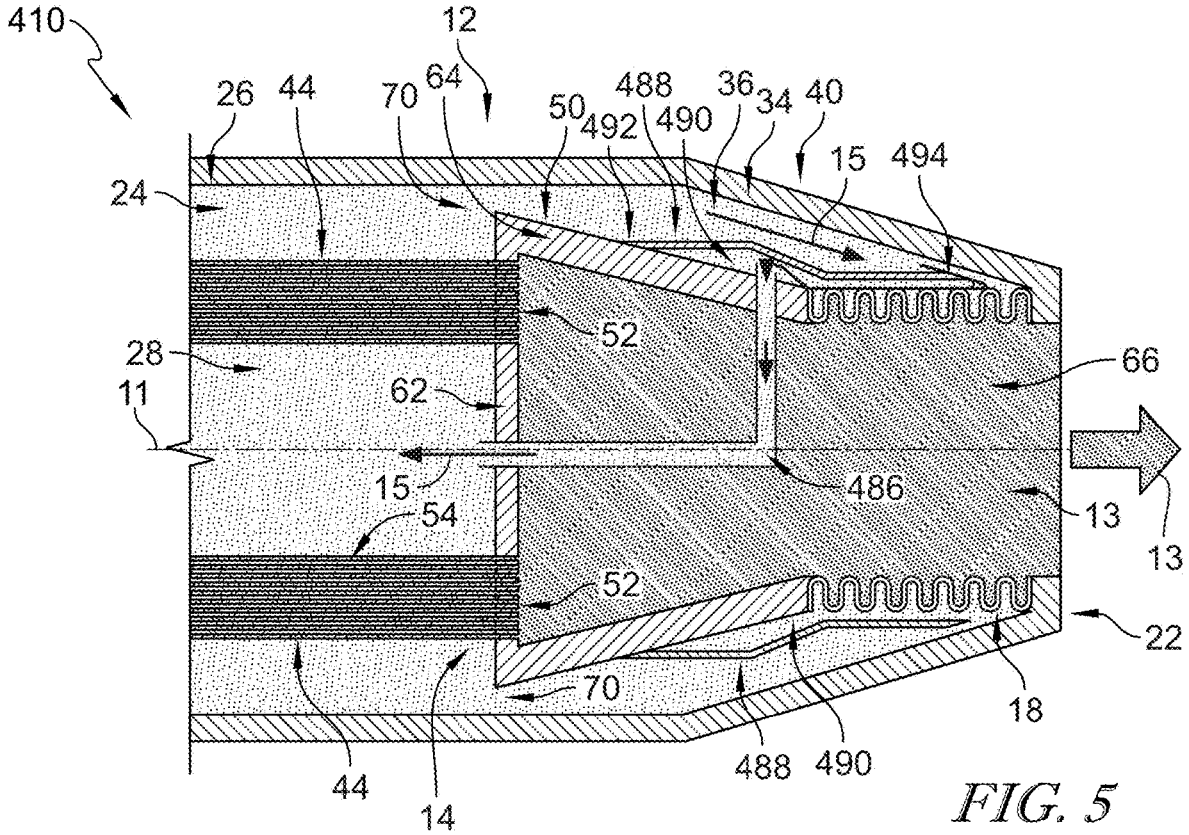
FIG. 5 is a detailed view of another embodiment of the heat exchanger of FIG. 2 showing that the heat exchanger further includes a cavity bleed extending between the axially-extending wall and an end plate of the header to direct coolant from one space defined by the shell to another space defined by the shell, and showing that the heat exchanger further includes a capture band to direct coolant along the expansion joint and into the cavity bleed.

As shown in FIG. 5, the heat exchanger 410 includes the shell 12, the core 14, and the second expansion joint 18 as described with reference to FIGS. 1, 2, and 7 above. The heat exchanger 410 further includes a cavity bleed 486 and a capture band 488. The cavity bleed 486 extends between the axially-extending wall 64 and the end plate 62 to pass the coolant 15 located in the header space 36 into the core space 28 to prevent the coolant 15 in the header space 36 from becoming too hot from the working fluid 13. The capture band 488 cooperates with the expansion joint 18 to define a coolant flow path 490 between the second end 22 of the shell and the cavity bleed 486 to encourage passage of the coolant 15 axially across the expansion joint 18. By allowing the coolant 15 to flow through the coolant flow path 490, the expansion joint 18 is cooled.

In the illustrative embodiment shown in FIG. 5, the cavity bleed 486 opens into the header space 36 via the axially-extending wall 64, extends radially inward from the shell 12 and axially away from the second end 22, and opens into the core space 28 via the end plate 62. The capture band 488 is coupled to the axially-extending wall 64 at a first end 492, extends axially towards the expansion joint 18 and the end 22 of the shell 12, and is spaced apart axially from the second end 22 of the shell 12 at a second end 494 of the capture band 488. The capture band 488 is arranged circumferentially around a portion of the axially-extending wall 64 and a portion of the expansion joint 18. Coolant 15 located radially outward of the capture band 488 is directed axially towards the second end 22, through the coolant flow path 490 between the capture band 488 and the expansion joint 18, and into the cavity bleed 486 to cool the expansion joint 18 and prevent the coolant 15 from becoming stagnant in the header space 36. The capture band 488 also blocks the expansion joint 18 from expanding or deflecting radially outward and encourages the expansion joint 18 to expand and contract axially.

Figure 6:
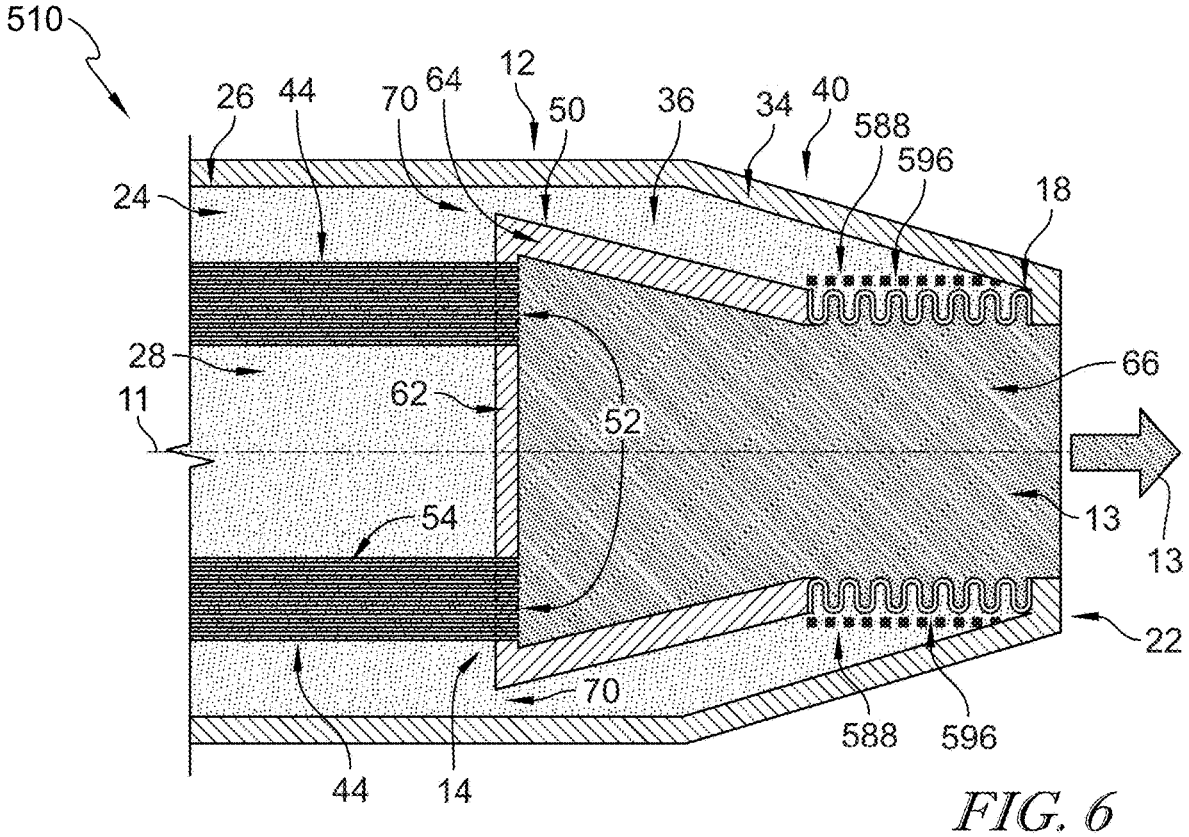
FIG. 6 is a detailed view of another embodiment of the heat exchanger of FIG. 2 showing that the heat exchanger further includes a capture band arranged circumferentially around the expansion joint to block radially-outward deformation of the expansion joint.

As shown in FIG. 6, the heat exchanger 510 includes the shell 12, the core 14, and the second expansion joint 18 as described with reference to FIGS. 1, 2, and 7 above. The heat exchanger 410 further includes a capture band 588. The capture band 588 is coupled to the second end 22 of the shell 12 and extends axially towards the axially-extending wall 64. The capture band 588 is arranged circumferentially around the expansion joint 18 and is formed to include a plurality of holes 596 to allow the coolant 15 between the inner diameter of the capture band 588 and the outer diameter of the expansion joint 18 to mix. The capture band 588 blocks expansion joint 18 from expanding, deflecting, or deforming radially outward and encourages the expansion joint 18 to expand and contract axially.

The heat exchanger 10, 210, 310, 410, 510 of the present disclosure provides a seal between the header 46, 50 and the shell 12 by extending the shell 12 axially past the header 46, 50 and adding an expansion joint 16, 18 axially between the shell 12 and the header 46, 50. The expansion joint 16, 18 may comprise bellows 16, 18. Each expansion joint 16, 18 is hermetically attached to the respective header 46, 50 and end 20, 22 of the shell 12, such as by welding or other means of attachment. The seal provided by the expansion joint 16, 18 blocks leakage of the coolant 15, which allows the heat exchanger 10, 210, 310, 410, 510 to be used in environments where leakage is unacceptable.

By adding the expansion joint 16, 18, external loads to the heat exchanger 10, 210, 310, 410, 510 are transmitted primarily to the shell 12 and mostly bypass the core 14. The plurality of tubes 44 are allowed to expand and contract relative to the shell 12. This protects the plurality of tubes 44 and prevents premature failure of the core 14 and/or heat exchanger 10, 210, 310, 410, 510.

The cavity bleed 486 purges the cavity 36 to help keep the temperature of the flow path 490 similar to the temperature of the coolant 15. This will help to keep the expansion joint 18 cooler where material properties are typically better for surviving mechanical stresses. In other embodiments, coolant 15 in the cavity 36 may also bleed outside the heat exchanger.

While the solutions shown in FIGS. 3-5 are illustrated to apply to the cavity 36, the solutions may also be applied to cavity 32 or both cavities 32, 36. The same solution may be applied to both cavities 32, 36 or different solutions may be used in each cavity 32, 36.

Different embodiments of the capture band 488, 588 are shown in in FIGS. 5 and 6. The capture band 488, 588 blocks radially-outward deformation of the expansion joint 18 caused by expansion joint instability (or squirm) and minimizes any radially-outward deformation of the expansion joint 18. The capture band 488, 588 may be a cylinder or a series of rods mounted into either the shell 12 or the header 50. While the capture band 488, 588 shown in FIGS. 4 and 5 are illustrated to apply to the expansion joint 18, the capture band 488, 588 may also be applied to expansion joint 16 or both expansion joints 16, 18. The same embodiment of the capture band 488, 588 may be applied to the expansion joints 16, 18 or different embodiments of the capture band 488, 588 may be used with each expansion joint 16, 18.

One example for assembly the heat exchanger 10, 210, 310, 410, 510 is provided below. It is noted that other methods may also be used to assembly the heat exchanger 10, 210, 310, 410. As an example for assembling the heat exchanger 10, 210, 310, 410, 510, the first shell body 38 is provided. An insert is provided comprising the core 14 the expansion joint 16 coupled to the header 46 and the expansion joint 18 coupled to the header 50. The second shell body 40 is provided with the core 14 coupled to the second shell body 40 at the second end 22 via the expansion joint 18 being coupled to the second end 22. The core 14 with the expansion joints 16, 18 is inserted into the first shell body 38 such that the first end 20, the expansion joint 16, and the header 46 are arranged axially. The second shell body 40 is then joined with the first shell body 38. The first shell body 38 and the second shell body 40 may be joined with the bolted joint 42B or the weld joint 42W.

After the shell bodies 38, 40 are joined, the expansion joint 16 is welded to the first shell body 38 at the first end 20. The expansion joint 16 is in compression during the welding process so that more relative thermal growth of the core 14 relative to the shell 12 is accounted for. In other words, during thermal expansion of the core 14, the expansion joint 16 would go from tension to compression rather than unstressed to compression. To pre-stress the expansion joint 16, the expansion joint 16 is pushed towards the first end 20. This causes the opposite expansion joint 18 to be in tension. After the weld between the expansion joint 16 and the first end 20, the expansion joint 16 is released and both expansion joints 16, 18 are in tension, but at a lower tension than the expansion joint 18 was previously. In other embodiments, the core 14 with the expansion joints 16, 18 may not be coupled to the second shell body 40 when inserted into the first shell body 38. In such embodiments, the expansion joint 18 is welded to the second shell body 40 at the second end 20 after the shell bodies 38, 40 are joined. The heat exchanger 10, 210, 310, 410 may also be assembled by other methods.

The tab 72 blocks the fluid pressure load on the core 14 from overloading the expansion joints 16, 18. In other words, the tab 72 blocks the fluid pressure in the header 45 from causing the header 46 to move axially past the tab 72, and blocks the plurality of tubes 44 and the header 50 from moving, towards the second end 22. This therefore blocks the pressure load from being transferred to the expansion joint 18. The tab 72 may be a dowel pin.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A multi-piece heat exchanger for transferring heat between a hot working fluid and a coolant comprising a multi-piece shell arranged around an axis and receiving a coolant therein, the multi-piece shell extending axially relative to an axis between a first end and a second end, and the multi-piece shell including a first shell body and a second shell body coupled with the first shell body about a circumferential joint to define a cavity for receiving the coolant therein, a core located within the cavity of the multi-piece shell and directing a working fluid therethrough, the core including a plurality of tubes extending axially relative to the multi-piece shell and defining a tube flow path for the hot working fluid, a first header coupled to a first end of the plurality of tubes to distribute the hot working fluid through the plurality of tubes, and a second header coupled to a second end of the plurality of tubes to receive cooled working fluid, wherein the coolant in the multi-piece shell flows around and between the plurality of tubes to cool the hot working fluid, and a first expansion joint and a second expansion joint, the first expansion joint coupled to the first shell body at the first end of the multi-piece shell and the first header and the second expansion joint coupled to the second shell body at the second end of the multi-piece shell and the second header to provide seals between the core and the multi-piece shell, the first and second expansion joints each including bellows configured to transmit external forces through the shell and to allow thermal expansion of the plurality of tubes relative to the multi-piece shell to minimize thermal stresses in the plurality of tubes so that the thermal stresses are blocked from damaging the plurality of tubes.

2. The multi-piece heat exchanger of claim 1, wherein the first header includes a first end plate coupled to the first end of the plurality of tubes and an axially-extending wall coupled between the first end plate and the first expansion joint, and wherein the first end plate, the axially-extending wall, and the first expansion joint cooperate to define an inlet flow path for the hot working fluid into the plurality of tubes, and wherein the second header includes a second end plate coupled to the second end of the plurality of tubes and an axially-extending wall coupled between the second end plate and the second expansion joint, and wherein the second end plate, the axially-extending wall, and the second expansion joint cooperate to define an outlet header flow path for the cooled working fluid out of the plurality of tubes.

3. The multi-piece heat exchanger of claim 2, wherein the multi-piece heat exchanger further includes a tab coupled to the second shell body of the multi-piece shell, the tab extending radially-inward from the multi-piece shell and engaging a core-facing surface of the inlet end plate to block axial movement of the inlet header beyond a plate-facing surface of the tab towards the second end of the multi-piece shell and to prevent the first expansion joint from overloading.

4. The multi-piece heat exchanger of claim 1, wherein the second shell body is separable from the first shell body.

5. The multi-piece heat exchanger of claim 1, wherein the circumferential joint is a bolted joint.

6. The multi-piece heat exchanger of claim 1, wherein the circumferential joint is a weld joint.

7. The multi-piece heat exchanger of claim 1, wherein the multi-piece heat exchanger further includes a baffle located axially between the inlet header and the outlet header, the baffle being coupled to and extending radially inward from the multi-piece shell to direct flow of the coolant.

8. The multi-piece heat exchanger of claim 1, wherein the first expansion joint, the second expansion joint, and the core are provided as an insert located within the multi-piece shell.

* * * * *